US006554578B1

(12) United States Patent
Siegel

(10) Patent No.: US 6,554,578 B1
(45) Date of Patent: Apr. 29, 2003

(54) DIAPHRAGM PUMP AND DEVICE FOR CONTROLLING SAME

(75) Inventor: Norbert Siegel, Hamburg (DE)

(73) Assignee: Bran & Luebbe GmbH (DE)

( * ) Notice: Subject to any disclaimer, the term of this patent is extended or adjusted under 35 U.S.C. 154(b) by 0 days.

(21) Appl. No.: 09/719,650

(22) PCT Filed: May 22, 1999

(86) PCT No.: PCT/EP99/03541

§ 371 (c)(1),
(2), (4) Date: Apr. 9, 2001

(87) PCT Pub. No.: WO99/66204

PCT Pub. Date: Dec. 23, 1999

(30) Foreign Application Priority Data

Jun. 16, 1998 (DE) ..... 198 26 610

(51) Int. Cl.[7] ..... F04B 19/24; F04B 9/08
(52) U.S. Cl. ..... 417/53; 417/383; 417/395
(58) Field of Search ..... 417/53, 383, 385, 417/388, 395

(56) References Cited

U.S. PATENT DOCUMENTS

| | | | | |
|---|---|---|---|---|
| 4,353,684 A | | 10/1982 | Christman | 417/388 |
| 4,436,491 A | | 3/1984 | Ishiyama | 417/385 |
| 4,621,989 A | * | 11/1986 | Burgert | 417/383 |
| 4,828,464 A | * | 5/1989 | Maier et al. | 417/388 |
| 5,047,950 A | * | 9/1991 | Fritsch et al. | 364/510 |
| 5,056,036 A | | 10/1991 | Van Bork | 364/510 |
| 5,249,932 A | * | 10/1993 | Van Bork | 417/386 |
| 5,516,429 A | * | 5/1996 | Snodgrass et al. | 417/395 |
| 5,655,894 A | * | 8/1997 | Fritsch | 417/387 |

FOREIGN PATENT DOCUMENTS

| | | |
|---|---|---|
| DE | 2 102 762 | 8/1972 |
| DE | 42 30 662 A1 | 3/1993 |
| DE | 43 09 380 A | 9/1994 |
| DE | 44 20 863 A1 | 12/1995 |
| EP | 0 085 725 A1 | 8/1983 |
| EP | 0 607 308 B | 1/1997 |
| WO | 93/07389 | 4/1993 |

* cited by examiner

*Primary Examiner*—Charles G. Freay
*Assistant Examiner*—Michael K. Gray
(74) *Attorney, Agent, or Firm*—Baker & Hostetler LLP

(57) ABSTRACT

The invention relates to a diaphragm pump with a device for controlling the position of a diaphragm separating the conveying chamber from the displacement chamber. As a replacement of the mechanical control of the refilling process, a pressure sensor is arranged in the displacement chamber, which is connected with an evaluation unit designed for generating a refill signal, which is switched so it actuates a refill valve through an operative connection. Advantageously, a second sensor for detecting the piston travel is provided, whose signal is linked with the signal from the pressure sensor. The invention furthermore relates to a method for controlling the position of a diaphragm.

12 Claims, 3 Drawing Sheets

DIAPHRAGM PUMP AND DEVICE FOR CONTROLLING SAME

Figure 1:
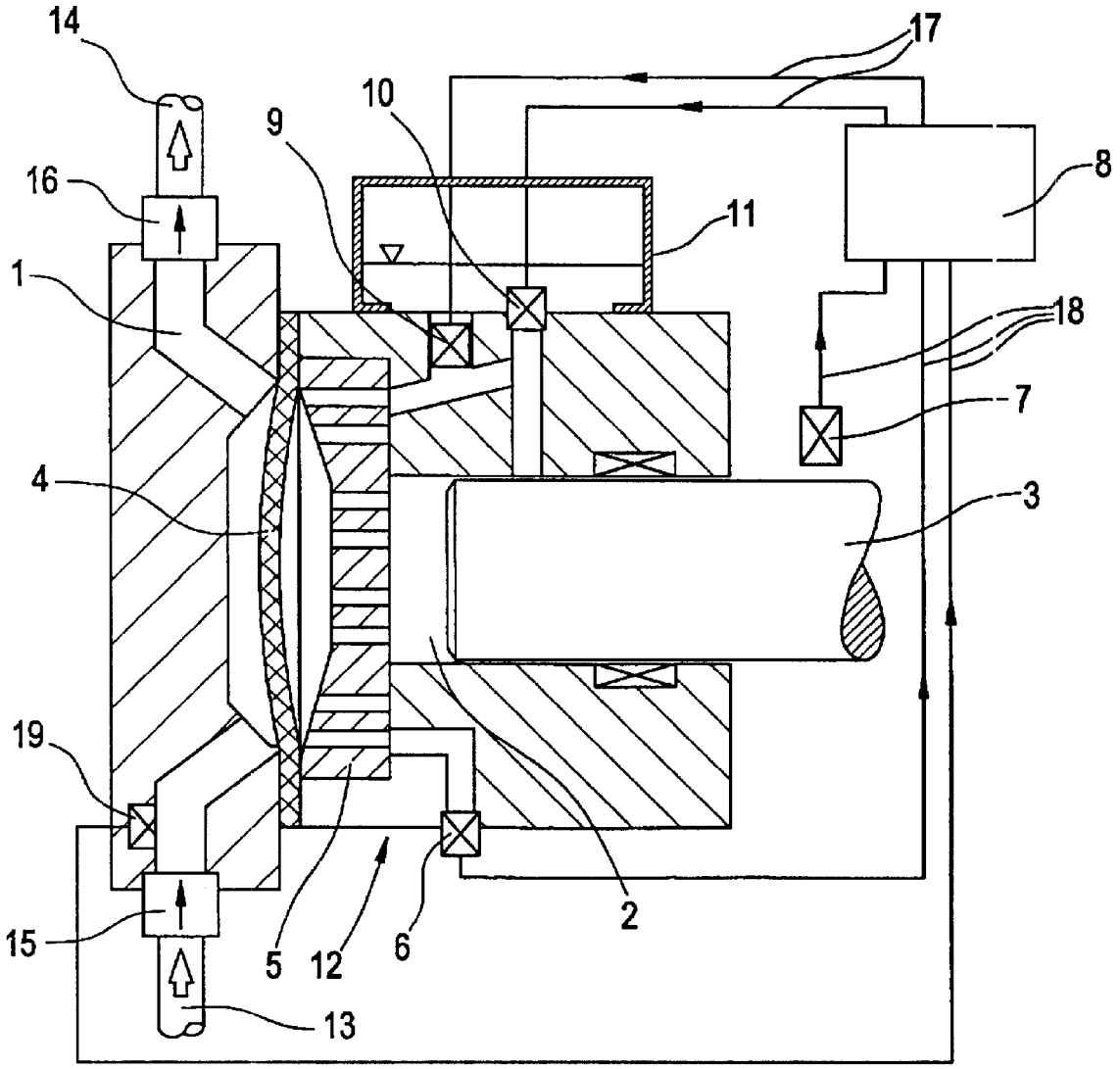

The invention relates to a diaphragm pump with a device for controlling the position of a diaphragm, which separates a conveying chamber from a displacement chamber, and with a reservoir for the hydraulic medium, which is in connection with the displacement chamber viva refilling unit.

The invention moreover relates to a method for controlling a diaphragm, which separates the conveying chamber from the displacement chamber of a diaphragm pump and which is driven by an oscillating displacer by means of a hydraulic medium, wherein the displacement chamber is resupplied with hydraulic medium via a line as needed.

Pumps of this type are known in the form of a piston diaphragm pump-from EP A1 0 085 725. The piston diaphragm pump has a displacement piston, which is oscillatingly moved back and forth in a displacement chamber, which is completely filled with a hydraulic medium. Because of this, the diaphragm arranged between the conveying chamber and the displacement chamber performs a diaphragm stroke, which corresponds to the volume of the piston stroke.

During the intake stroke, the fluid to be conveyed flows into the conveying chamber via the inlet valve, and is expelled via the head valve during the pressure stroke.

In most cases, a support plate, which can be displaced over a limited range, is provided in the displacement chamber and protects the diaphragm against an excessive deflection toward the end of the intake stroke.

If, after a defined period of operation, the inevitably occurring losses of hydraulic medium lead to the diaphragm position at the end of the intake stroke being slowly displaced toward the displacement chamber, the diaphragm arrives at the support plate or at a plunger, which senses the diaphragm position. The support plate or the plunger are displaced by the diaphragm against the pressure of springs in the direction toward the displacement work chamber. The plunger, which senses the diaphragm position directly, or the support plate, mechanically unblock a refilling valve in the process, which is opened because of the underpressure prevailing in the displacement work chamber and permits hydraulic medium to flow from a reservoir into the displacement work chamber. In the course of this, the diaphragm and the support plate again move under the pressure of the springs in the direction toward the conveying chamber. During the course of this movement the closure device of the refilling valve also slides again in the direction toward the conveying chamber and closes the refilling valve.

An impairment of the conveying properties of the diaphragm pump can arise as a result of the expulsion of air originally dissolved in the hydraulic medium. In such cases it is necessary to permit a volume to escape from the displacement chamber. A so-called venting valve is provided for this purpose, which makes possible the escape of excess amounts of hydraulic medium or released air. In the course of the initial operation of a diaphragm pump, or of a change of the set stroke length of the connected pump operating unit, the venting valve is simultaneously used to remove excess amounts of hydraulic medium from the displacement chamber in order to assure the function of the mechanical refilling device.

Such a venting valve is known, for example, from the company publication "AREX" of Applicant.

The direct determination of the limit positions of the diaphragm by means of an electronic sensor as a replacement for the mechanical determination of the instantaneous diaphragm location has been proposed in EP B1 0 607 308. The electronic signal of the position sensor is compared with a predetermined maximum value in a control unit. In case the maximum value is exceeded, a signal for opening a refilling valve is generated, which prevents an overload of the diaphragm. The disadvantage of this previously known solution lies in that a mass-containing magnet, whose magnetic field is required by the electronic sensor for detecting the location of the diaphragm, must be attached to the diaphragm for detecting the position of the diaphragm. The uneven mass distribution on the diaphragm required for this can lead to locally increased loads, which disadvantageously reduces the service life expectancy of the diaphragm. Because of the omission of a diaphragm stop, or support plate, on the displacement chamber side, refilling the hydraulic chamber in case of an operation at an admission pressure in the suction line, which lies above the pressure of the ambient air, is only possible if, by means of an additional pressure generator, the amount of hydraulic fluid to be replaced is brought to a somewhat slightly higher pressure than the admission pressure in the suction line In addition, the lack of the diaphragm stop can lead to an overload of the diaphragm under certain operating conditions.

Finally, a device for an electronic check of the diaphragm position in diaphragm process pumps is known from DE A1 43 36 823, wherein the position of the diaphragm is determined by means of an electromechanical or electronic transmitter and receiver. For an exact control for preventing breakage or premature wear by an overload, a signal, which controls the admission of the hydraulic medium to the displacement chamber, is generated by means of an electronic evaluation unit. An electromechanical sensor, which directly determines the position of the diaphragm by means of a spring-loaded plunger, is proposed for detecting the diaphragm position. In this case, too, the diaphragm is additionally stressed by the force of the plunger, which basically results in a reduced life expectancy of the diaphragm.

It is the object of the invention to create a diaphragm pump, wherein the volume of the displacement chamber can be checked in the simplest possible way, so that the diaphragm is treated gently and the operational dependability of the pump as a whole is increased.

This object is attained in connection with the diaphragm pump in accordance with the species in that a pressure sensor is arranged in the displacement chamber, which is connected with an evaluation unit designed for generating a refill signal, so that a refill unit is actuated by means of an operative connection. The pressure sensor located in the displacement chamber reports the creation of an underpressure during the intake stroke to the evaluation unit. There, this signal is compared, for example with a predetermined threshold value. As soon as the predetermined threshold value has been exceeded, the evaluation unit generates a signal which causes the refilling of the displacement chamber with hydraulic fluid. Overloading of the diaphragm is assuredly prevented in this way. The threshold value can be easily adapted to various operating conditions. Since the pressure sensor has no movable parts, the operational dependability is advantageously increased in comparison with mechanical systems. The diaphragm is not additionally stressed by the pressure sensor, since the latter is not in direct contact with the diaphragm and instead only comes into contact with the hydraulic medium.

Thus, the invention is based on the electronic evaluation of the chronological course of pressure in the displacement chamber of a hydraulically controlled diaphragm pump. Also, a selective allocation of this course of the pressure to the displacer position takes place. The correct filling of the displacement chamber is assured by means of an algorithm being run in a computer unit and by a refill unit, which is actuated by an operative connection. Occurring leaks, or a lack of hydraulic medium in the displacement chamber, are detected and a replacement is provided again.

If a support plate for the diaphragm is arranged in the displacement chamber, an additional, more distinctive underpressure pulse is generated in the displacement chamber as soon as the diaphragm comes to rests against the support plate during the intake stroke. This underpressure pulse can be evaluated even more precisely by the evaluation unit and a signal for refilling can be generated from this, which advantageously increases the operational dependability of the pump. For initiating the refilling process it is then possible for the evaluation unit to check that, for example, two criteria have been simultaneously met, i.e. that the diaphragm has reached its rearmost contact position and that the pressure in the hydraulic chamber lies slightly below the ambient pressure in the reservoir.

Refilling can be provided in a particularly advantageous manner if the refill unit is embodied as a valve, preferably an electrically actuated valve, which is arranged in the refill line Can make a connection between the displacement chamber and the reservoir for the hydraulic medium. Already operational diaphragm pumps can also be simply retrofitted, so that the advantages of the electronic triggering of the refill valve can also be utilized in connection with older pumps.

Because the evaluation unit is embodied to generate a venting signal, which is switched so it actuates a venting unit, it is also possible at a time during a work cycle of the displacer, in which the pressure in the displacement chamber is greater than the ambient pressure in the reservoir for the hydraulic fluid, to remove released air, which originally had been dissolved in the hydraulic medium, from the displacement chamber, if needed.

Because venting and replenishing of the displacement chamber take place at different-times, it is advantageously possible to do without separate valves. Both functions can be performed by the same valve if the venting valve and the refill valve are designed as one component. It is alternatively possible to remove the released air, which was originally dissolved in the hydraulic medium, from the displacement chamber through both the refill valve itself and through a further structurally equivalent, for example electromagnetically triggered venting valve. The refill and the venting valves can be designed to be structurally equivalent. The venting and the refilling processes take place as needed and not necessarily during each work cycle.

A further option without the use of a position sensor consists in the arrangement of a pressure sensor in the conveying chamber of the diaphragm pump in addition to the pressure sensor in the displacement chamber, with a signal connection to the evaluation unit. A linkage of the two sensor signals, for example by means of a differential formation, can take place in the evaluation unit, and the refill signals, or venting signals, can be generated.

By means of this, the dependable switching of the refill and of the venting valves is also assured under all operating conditions.

Alternatively, the pressure sensors can be designed as sensors for detecting the expansion of the housing components of the conveying chamber and the displacement chamber. These provide signals which are proportional to the pressure signals. The evaluation for generating the refill, or venting, signals can take place through appropriate signal connections to the evaluation unit.

Advantageously, the determination of the displacer position takes place in addition to detecting the pressure in the displacement chamber in that a position sensor is provided for signaling the displacer position, and a signal connection from the position sensor to the evaluation unit is provided. This additional information regarding the position of the piston, and the linkage of the piston position with the pressure signal allows additional interlocks, which dependably prevent the switching of the venting, or the aeration, valves at the wrong time.

Moreover, the arrangement of respectively a pressure sensor in the conveying chamber, a pressure sensor in the displacement sensor and a position sensor for detecting the displacer position, along with their respective signal connections to the evaluation unit, and the combined evaluation of all three sensor signals are possible.

In connection with the method for controlling the position of a diaphragm separating the conveying and the displacement chambers of a diaphragm pump, wherein the displacement chamber, which is equipped with a support plate, through which the hydraulic medium can flow, is connected via a refill unit with the displacement chamber, the attainment in accordance with the invention of the object provides that the pressure signal in the displacement chamber is detected by a sensor and is conducted to an evaluation unit which, in accordance with a defined algorithm, causes the refilling of the displacement chamber with a hydraulic medium as required from this and, if required, the venting of released gas portions, which originally had been dissolved in the hydraulic medium, from the displacement chamber.

Under certain conditions it is also possible to process a derivation in accordance with time or distance as the signal, instead of the measured actual pressure signal.

The pressure in the displacement chamber is advantageously detected by a sensor and is forwarded to an evaluation unit, which causes the venting of the displacement chamber in accordance with a defined algorithm.

The dependability of the method is further increased by a step, wherein the position of the displacer is detected, for example by an angle encoder on the driveshaft, and is provided to the evaluation unit, and the signal is linked with the pressure in the displacement chamber by the evaluation unit.

For causing refilling and/or venting of the displacement chamber, it is also alternatively or complementarily possible to detect the pressure in the conveying chamber and to provide it to the evaluation unit, and for the evaluation unit to link the signal with the pressure in the displacement chamber.

The invention will be described by means of a preferred embodiment, making reference to the drawings, wherein further advantageous details can be taken from the drawing figures. Functionally equivalent parts have been provided with the same reference numerals here.

Figure 2:
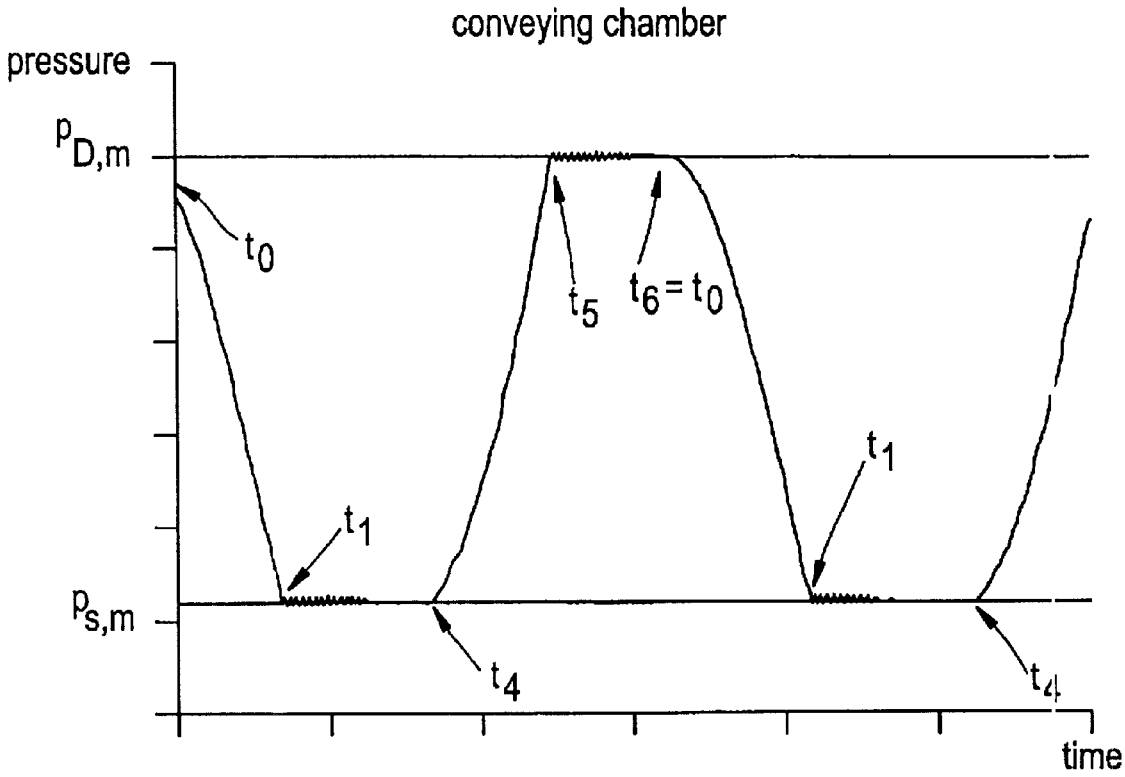
Figure 3:
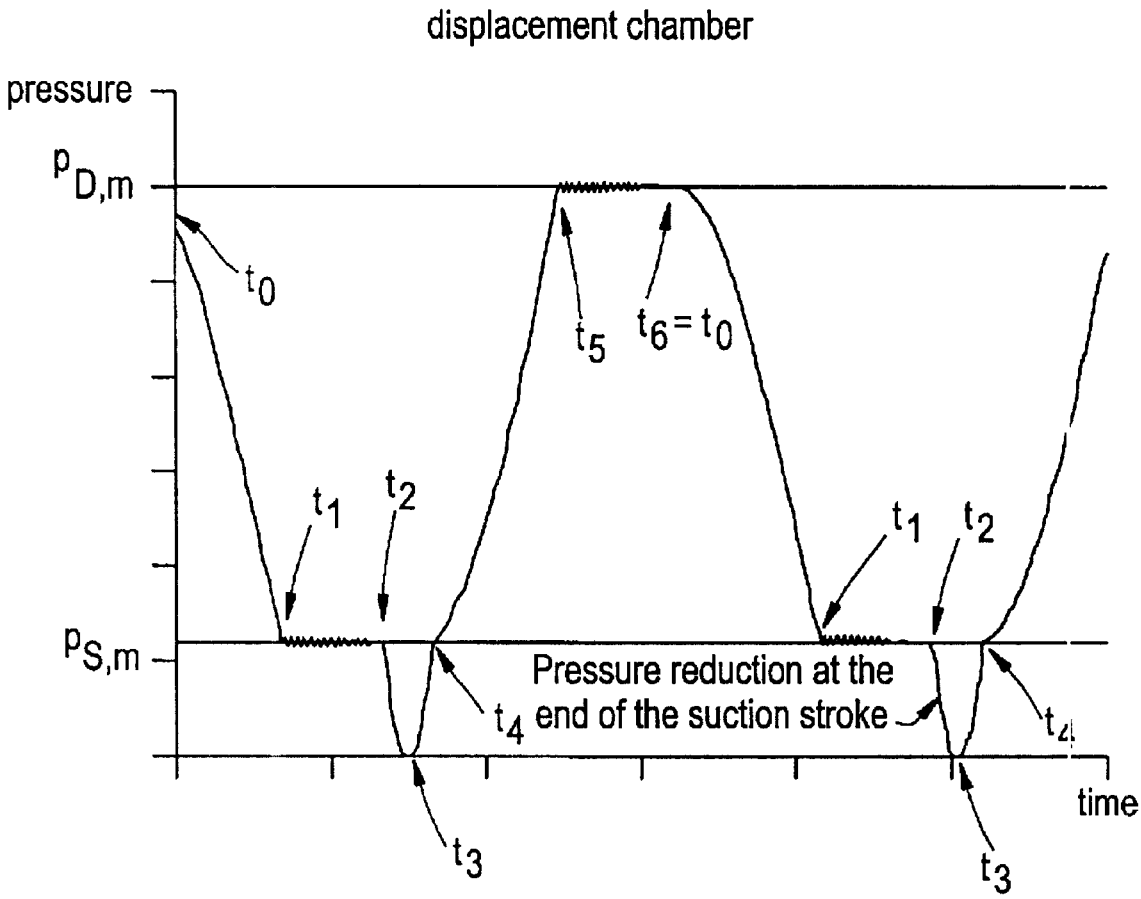

The following is shown in detail in the drawings in:

FIG. 1, a sketch of a hydraulically linked diaphragm pump head with the electronic control for filling the displacement chamber, FIG. 2, a diagram of the course of pressure in the conveying chamber of a hydraulically linked diaphragm pump without the refilling process, and FIG. 3, a diagram of the course of pressure in the displacement chamber of a hydraulically linked diaphragm pump.

The structure of a hydraulically linked diaphragm pump head with an electronic control in accordance with the invention is represented in FIG. 1. A course of pressure in accordance with FIG. 2 typically occurs in the conveying chamber 1 of the diaphragm pump head 12 as a function of time. The oscillating movement of the displacer 3 is transferred to the diaphragm 4 here by the hydraulic medium, which is contained in the displacement chamber 2 and is under alternating pressure. If an intended or unintentional leak occurs in the displacement chamber 2, a lack of hydraulic fluid occurs there. As a result, at the end of the intake stroke the diaphragm 4 reaches the rear contact position, which is arranged in the displacement chamber and through which medium can flow and which is preferably Its displacers embodied as a perforated plate 5, before the displacer 3 has reached its lower dead position. Because of this, the movement of the diaphragm 4 and the displacer 3 are uncoupled. As a result, the pressure in the conveying chamber 1, which is detected by a pressure sensor 19, remains at the level of pressure in the intake line 13. The pressure in the displacement chamber 2 falls below the level in the conveying chamber 1 down to the vapor pressure of the hydraulic fluid. The course of pressure over time, which typically occurs in the displacement chamber 2 of the hydraulically linked diaphragm pump head in accordance with FIG. 1 and which can be detected by the pressure sensor 6, is represented in FIG. 3. In comparison with FIG. 2, the lowering of the pressure toward the end of the intake stroke, which occurs when the diaphragm 4 is in contact with the perforated plate 5, can be clearly seen.

The refilling process can only occur through the refill valve 9, since there is a pressure drop between the hydraulic fluid in the reservoir 11, which is at the pressure of the ambient air, and the displacement chamber 2. The detection of the pressure drop in the hydraulic chamber 2 toward the end of the intake stroke takes place by means of the evaluation of the signal from the pressure sensor 6 and, if needed, additionally by linkage with the signal of the position sensor 7 in the evaluation unit 8. The evaluation unit is designed as a freely programmable computer unit. The position sensor 7 indicates the instantaneous position of the displacer 3. The linkage of the signals from the position sensor 7 and the pressure sensor 6 prevents interfering pressure drops in the displacement chamber, for example, because of fluid fluctuations, or throttling caused by cross section reductions in the suction line, lead to the actuation of the refilling process. Thus, the algorithm running in the evaluation unit 8 decides in a useful manner the blockage or release of the refilling process through the refill valve 9.

In addition, the algorithm in the computer unit 8 can release the venting valve 10 at a different time than the refill valve 9, as soon as there is a pressure drop from the displacement chamber 2 in the direction of the reservoir 11. It is possible in this way to expel excess hydraulic medium, for example as a result of a stroke change in the pump operating unit, and/or of released gases, which originally had been dissolved in the hydraulic medium, from the displacement chamber 2. Because of the chronological separation of the refill and the venting process, it is possible to provide both functions of the otherwise structurally equivalent valves 9 and 10 in only a single component.

At the time $t_0$, the piston is in its end position on the diaphragm side. The head valve 16 is closed at this time. Subsequently, the piston releases the pressure of the conveying medium enclosed between the closed head valve 16 and the intake valve 15, including that of the hydraulic medium contained in the displacement chamber until, at the time t1, the media reach the mean pressure in the suction lime $p_{sm}$, and the intake valve 15 is opened. The piston continues to move and now aspirates conveying medium from the conveying line until, at the time $t_2$, the diaphragm 4 rests against the perforated plate 5 and the pressure in the displacement chamber falls below the mean pressure $p_{sm}$ in the-intake line. At the time $t_3$, the refill valve 9 is briefly opened. Therefore, the piston passes its reversing position and causes the intake valve 15 to close at the time $t_4$. The medium enclosed in the conveying chamber is thereafter compressed to the mean pressure and the pressure line $p_{dm}$. As soon as this has been reached, the pressure valve is opened at the time $t_5$. In the course of the further movement of the piston, the conveyed volume is expelled out of the conveying chamber 1 through the head valve 16, until the piston has reached its other reversing position and the head valve is closed at the time $t_6$. Thereafter, a new operation is started. The diagram is an idealized representation. Deviations are possible in actual use. For example, shocks in the intake and pressure lines, as well as venting processes, can change the diagram.

It is possible to check the functions of the seals by means of a counter in the evaluation unit 8, which records the refilling process and detects the frequency. Depending on the leak conditions, maintenance can be performed when required. In the end, the mounting of the pump also becomes easier, since the adjustment of the mechanical refilling device is omitted. The required setting procedures can be performed directly at the evaluation unit during operation.

Therefore the evaluation device advantageously has a non-volatile data memory, which stores the appropriate data for a number of strokes in the case of an interruption of the operation for later diagnosis, and makes them available thereafter in a readout.

If the evaluation unit 8 is additionally equipped with an interface with a communications network, it is possible to check the operation of the pump remotely and to detect possible errors.

A diaphragm pump has been created in this way, which makes it possible to incorporate the pump into a network which provides further useful information regarding the production process.

LIST OF REFERENCE NUMBERS

1 Conveying chamber
2 Displacement chamber
3 Piston (displacer)
4 Diaphragm
5 Perforated plate (support plate)
6 Pressure sensor
7 Position sensor
8 Evaluation unit
9 Refill valve
10 Venting valve
11 Reservoir for hydraulic fluid
12 Diaphragm pump head
13 Intake line
14 Pressure line
15 Intake valve
16 Head valve
17 Control line
18 Signal line
19 Pressure sensor

What is claimed is:

1. A diaphragm pump with a device for controlling the position of a diaphragm that separates a conveying chamber from a displacement chamber, and with a reservoir for a hydraulic medium, which is in connection with the displacement chamber via a refilling unit, comprising:

a pressure sensor arranged in the displacement chamber, said pressure sensor being connected to an evaluation unit designed for generating a refill signal, so that a refill unit is actuated by means of an operative connection.

2. The diaphragm pump in accordance with claim 1, further comprising a support plate for the diaphragm, said support plate being arranged in the displacement chamber.

3. The diaphragm pump in accordance with claim 1, wherein the refilling unit is an electrically operated valve, which is arranged in a refilling line.

4. The diaphragm pump in accordance with claim 1, wherein the evaluation unit is designed to generate a venting signal, said signal being capable of being switched so it actuates a venting valve.

5. The diaphragm pump in accordance with claim 1, wherein the venting valve and the refill valve are embodied as one component.

6. The diaphragm pump in accordance with claim 1, further comprising a second pressure sensor arranged in the conveying chamber, said second pressure sensor having a signal connection with the evaluation unit.

7. The diaphragm pump in accordance with claim 1, wherein the pressure sensor is designed as an expansion sensor, which detects the expansion of a housing.

8. The diaphragm pump in accordance with claim 1, further comprising a position sensor for signaling a displacer position; and a signal connection between the position sensor and the evaluation unit.

9. A method for controlling the position of a diaphragm that separates a conveying and a displacement chamber of a diaphragm pump and is driven by an oscillating displacer by means of a hydraulic medium, wherein the displacement chamber can be refilled via a line with the hydraulic medium as required, comprising the steps of:

detecting the pressure in the displacement chamber by a sensor;

conducting a signal to an evaluation unit; and in accordance with a defined algorithm, causing the refilling of the displacement chamber with hydraulic medium.

10. The method in accordance with claim 9, further comprising the step of causing the venting of the displacement chamber in accordance with a defined algorithm.

11. The method in accordance with claim 9, further comprising the steps of detecting the position of a displacer; providing a signal to the evaluation unit; and linking said signal by the evaluation unit with the pressure signal from the displacement chamber.

12. The method in accordance with claim 9, further comprising the step of detecting the pressure in the conveying providing said pressure to the evaluation unit; and linking said pressure by the evaluation unit with the pressure signal from the displacement chamber.

* * * * *